US006394918B1

(12) United States Patent
Erhard

(10) Patent No.: US 6,394,918 B1
(45) Date of Patent: May 28, 2002

(54) PLAYING-FIELD ENCLOSURE

(75) Inventor: Kurt Erhard, Neusitz (DE)

(73) Assignee: Erhard Sport International GmbH & Co., Tauber (DE)

( * ) Notice: Subject to any disclaimer, the term of this patent is extended or adjusted under 35 U.S.C. 154(b) by 49 days.

(21) Appl. No.: 09/589,198

(22) Filed: Jun. 8, 2000

(30) Foreign Application Priority Data

Jul. 14, 1999 (DE) ..... 199 32 815

(51) Int. Cl.[7] ..... A63B 69/00

(52) U.S. Cl. ..... 473/421; 473/470; 473/471; 472/92; 472/94

(58) Field of Search ..... 473/422, 415, 473/470, 471, FOR 212; 472/92–94; 248/200, 218.4, 220.1, 224.61, 224.7, 160; 256/1, 19, 24, 73; 52/2.21, 2.13, 309.4, 309.6, 745.15

(56) References Cited

U.S. PATENT DOCUMENTS

| | | | | | |
|---|---|---|---|---|---|
| 3,830,374 A | * | 8/1974 | Kassimir | 248/224.7 |
| 4,698,278 A | * | 10/1987 | Prang | 428/314.4 |
| 4,792,144 A | * | 12/1988 | LaDue | 473/471 |
| 5,015,119 A | * | 5/1991 | Schmanski | 404/10 |
| 5,404,685 A | * | 4/1995 | Collins | 256/1 |
| 5,725,201 A | * | 3/1998 | Parth | 256/24 |
| 5,738,588 A | * | 4/1998 | Esser | 472/94 |
| 5,897,438 A | * | 4/1999 | Kunz et al. | 472/92 |
| 6,004,218 A | * | 12/1999 | Keating et al. | 472/94 |

FOREIGN PATENT DOCUMENTS

| | | | |
|---|---|---|---|
| DE | 8814094.6 | 2/1989 | |
| DE | 19539280 | 2/1997 | |
| DE | 29822132 | 4/1999 | |
| FR | 2417998 | 2/1978 | |
| FR | 2712906 | * 11/1993 | 472/94 |
| GB | 2332376 | 6/1999 | |
| WO | 93/00139 | 1/1993 | |

* cited by examiner

*Primary Examiner*—Paul T. Sewell
*Assistant Examiner*—Mitra Aryanpour
(74) *Attorney, Agent, or Firm*—Browdy and Neimark

(57) ABSTRACT

In a playing-field enclosure, particularly for ball games, having a peripheral, vertical band-including a plurality of sheet-type band elements that can be connected to one another with a form-fit in order to assure simple assembly and storage connecting elements are disposed between two respective sheet-type band elements, the connecting elements having a support surface and a connecting rib that extends vertically upward from the support surface; the connecting rib has vertically-extending U profiles on opposite sides or sides that are offset from one another by 90°, the band elements being inserted into the profiles with a form-fit; and the support surface has upwardly-extending retaining mandrels in the positioning region of the band elements, the mandrels engaging corresponding retaining recesses of the band elements inserted into the U profiles.

8 Claims, 3 Drawing Sheets

PLAYING-FIELD ENCLOSURE

FIELD OF INVENTION

The invention relates in general to a playing-field enclosure, particularly for ball games, comprising a peripheral, vertical band that is formed from a plurality of sheet-type band elements that can be connected in a form-fit. A playing-field enclosure of this general type is known from DE 195 39 280 C1.

This known playing-field enclosure has performed very well in practice, and creates the impression of a competition arena, which contributes to a sporting and competitive atmosphere. In the known arrangement, the individual sheet elements are connected in a form-fit to also assure a stable connection at the periphery; however, the band elements are surrounded by a tension-belt arrangement. Assembling this belt arrangement is a fairly involved process.

FR 2 417 998 describes a prefabricated platform for playing different kinds of sports; here, a raised playing surface is constructed on supports and is, again, secured to a playing-field enclosure. The playing-field enclosure has a frame-like structure, with the open spaces being covered by nets or the like. While this known arrangement offers the option of prefabrication, it is intended to be a permanent structure, and is therefore not suitable for quick disassembly and simple transport to another venue.

SUMMARY OF INVENTION

It is an object of the invention to provide a playing-field enclosure of the general type mentioned above, but having a high degree of stability when assembled, yet being simple to set up and transport, and being storable in a small space.

In accordance with the invention, this object is accomplished using connecting elements disposed between two respective sheet-type band elements; the connecting elements have a support surface and a connecting rib that extends vertically upward from the support surface, the rib having U profiles on opposite sides or sides that are offset by 90°. The band elements can be inserted, with a form-fit, into these profiles. In the positioning region of the band elements, the support surface has upward-extending retaining mandrels, which engage corresponding retaining recesses of the band elements inserted into the U profile.

This embodiment allows for an especially simple assembly. The connecting elements and corner connecting elements, as well as the band elements and the gates, which are provided as goals such as for a small soccer field, play area for hockey or lacrosse, basketball court or the like, are already in the position in which they are supposed to be assembled later, with the band elements merely being inserted between two connecting elements and anchored.

The band elements are preferably produced from high-resistance foam sheets and coated with steel plates, so they are lightweight and thus easy to handle, and yet possess a high surface stability.

For further stability, the band elements can be provided with a plastic frame, which also protects the edges and the end faces.

In a preferred embodiment, the support surface is formed by aluminum profiles arranged in a cross shape. The vertical connecting ribs are advantageously embodied as hollow profiles, so net-holding pins can be inserted into them with a form-fit. A net can then be stretched across these net-holding pins, which ensures that the ball will be kept on the field.

Within the scope of the invention, it may also be provided that the band elements can be connected to retaining mandrels mounted to the sides of the gates, in which case the gates have lateral U profiles for receiving the band elements. Also with respect to the gates, the basic connecting technique used to connect the band elements to one another is retained.

The gates can have a side section that is embodied as a door, which permits the entrance and exit of the playing field, thereby eliminating the need for special, static opening constructions in the bands.

It is advantageously provided that the band elements are seated in the connecting elements with "play", i.e. flexibility, at the top. This permits the compensation of uneven areas in the ground, as are often encountered in practice. Accordingly, the form-fitting securing of the band elements in the U profiles requires a certain amount of "play" to avoid tilting due to a slight tilted position of the connecting elements.

BRIEF DESCRIPTION OF DRAWING

The invention is described in detail below by way of a preferred embodiment illustrated in the drawings, which show in.

DETAILED DESCRIPTION OF EMBODIMENT(S)

Figure 1:
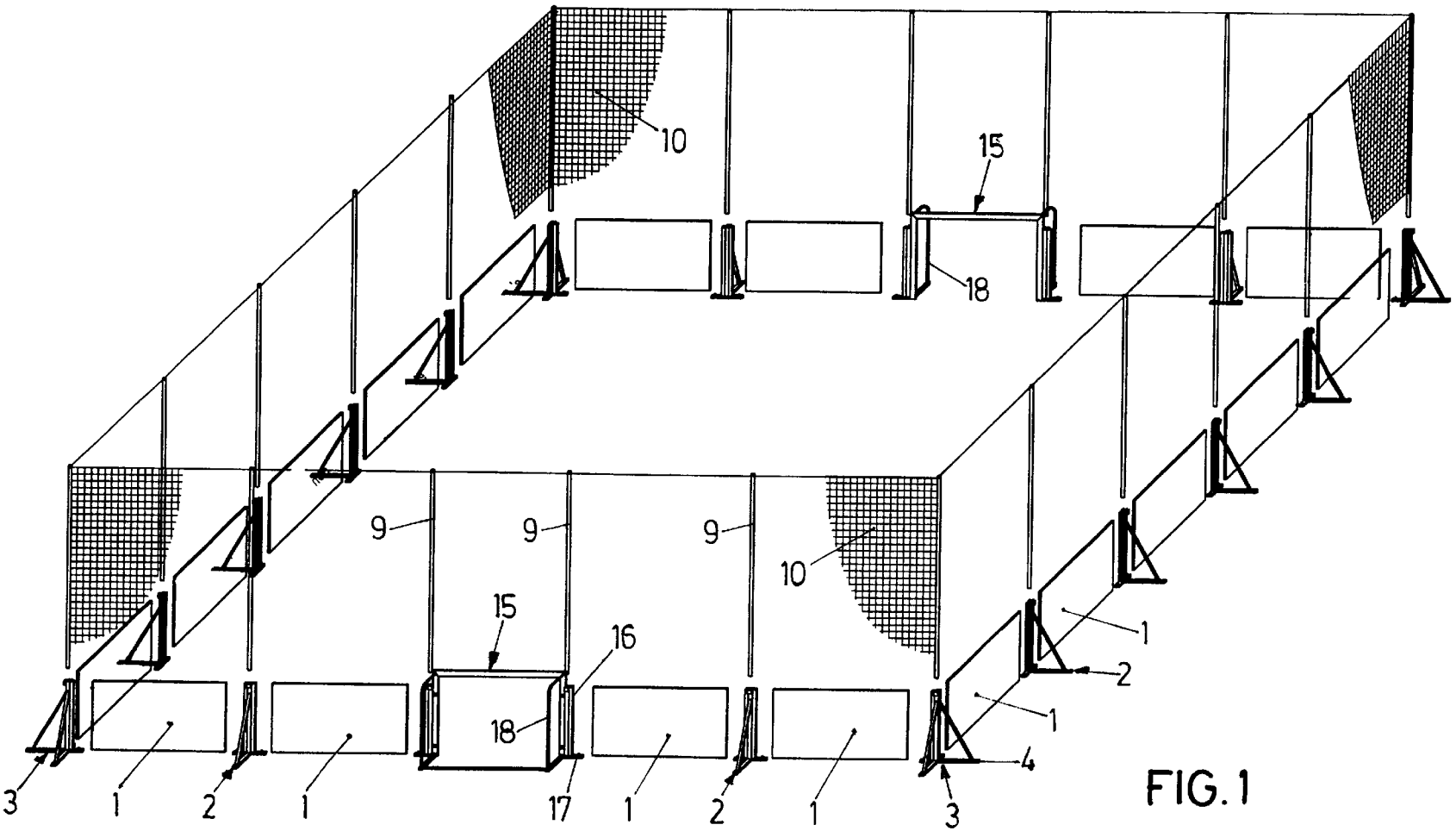
FIG. 1 is a view in perspective, partially exploded, of a playing-field enclosure in the constructed state.

The playing-field enclosure illustrated in the drawings includes a plurality of sheet-type band elements 1, which respectively comprise polyurethane high-resistance (HR) foam sheets that are laminated to steel plates and encased by a stabilizing plastic frame.

Connecting elements 2 and corner connecting elements 3, as shown in detail in FIGS. 2 and 3, serve in connecting the individual band elements 1 which are received in vertical grooves in the connecting elements 2 and 3 as explained in more detail below. These are shown separated (exploded view) in FIG. 1 so that all the elements can be more clearly seen.

Each connecting element includes a support surface 4 in the plane of the ground at the respective site; the support surface 4 is formed by aluminum profiles 5 in a cross arrangement. To provide stability, transverse connecting elements comprising aluminum profiles extend upward at a diagonal from the support surface 4, e.g. the profiles 5, and are welded at 8 to a connecting rib 7 that extends vertically upward from the support surface 4. The connecting rib 7 is embodied as a hollow profile, so net-holding pins 9 can be inserted vertically down into it to secure a net 10.

Figure 2:
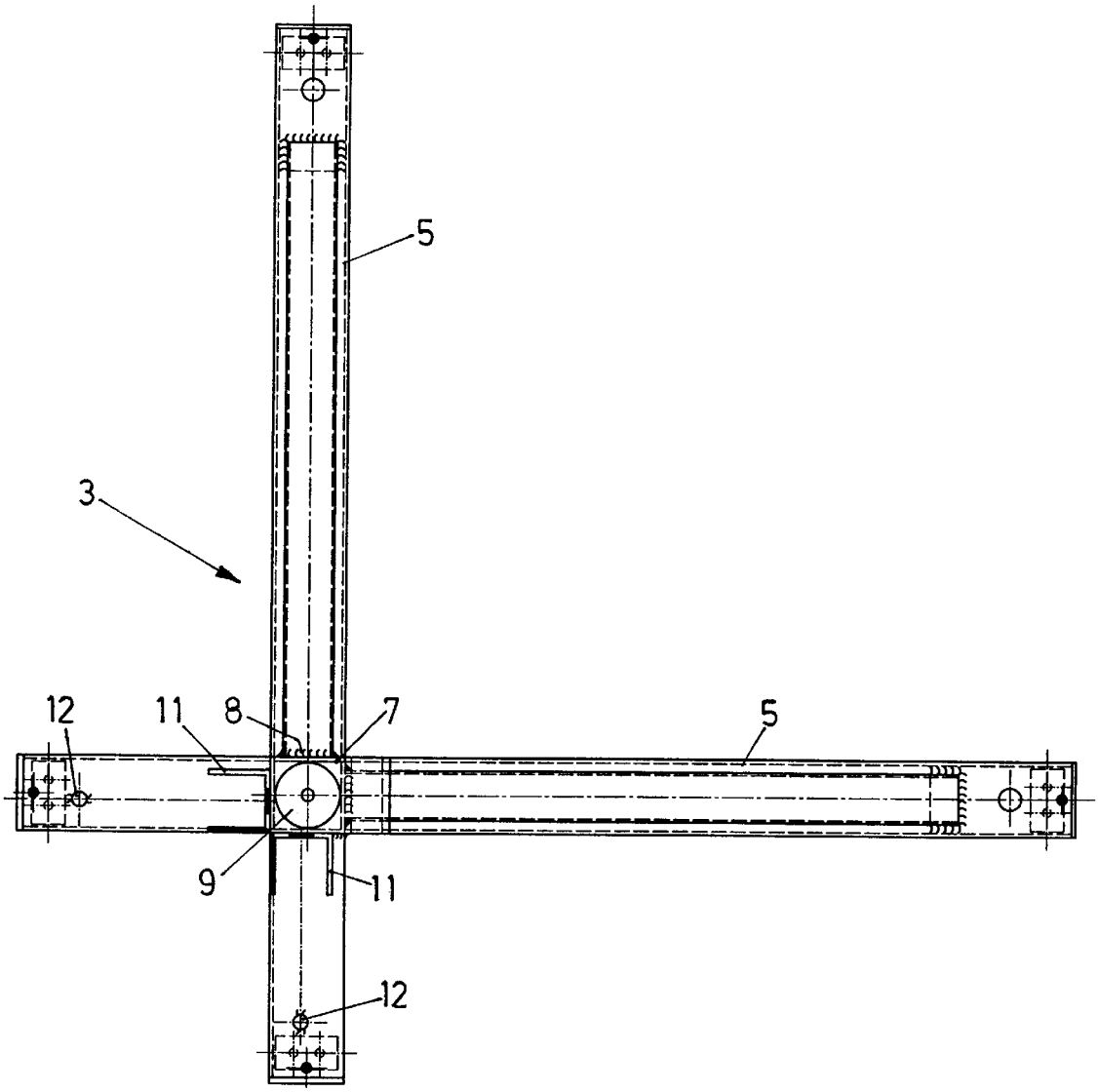
FIG. 2 is a top view of a corner connecting element.
Figure 3:
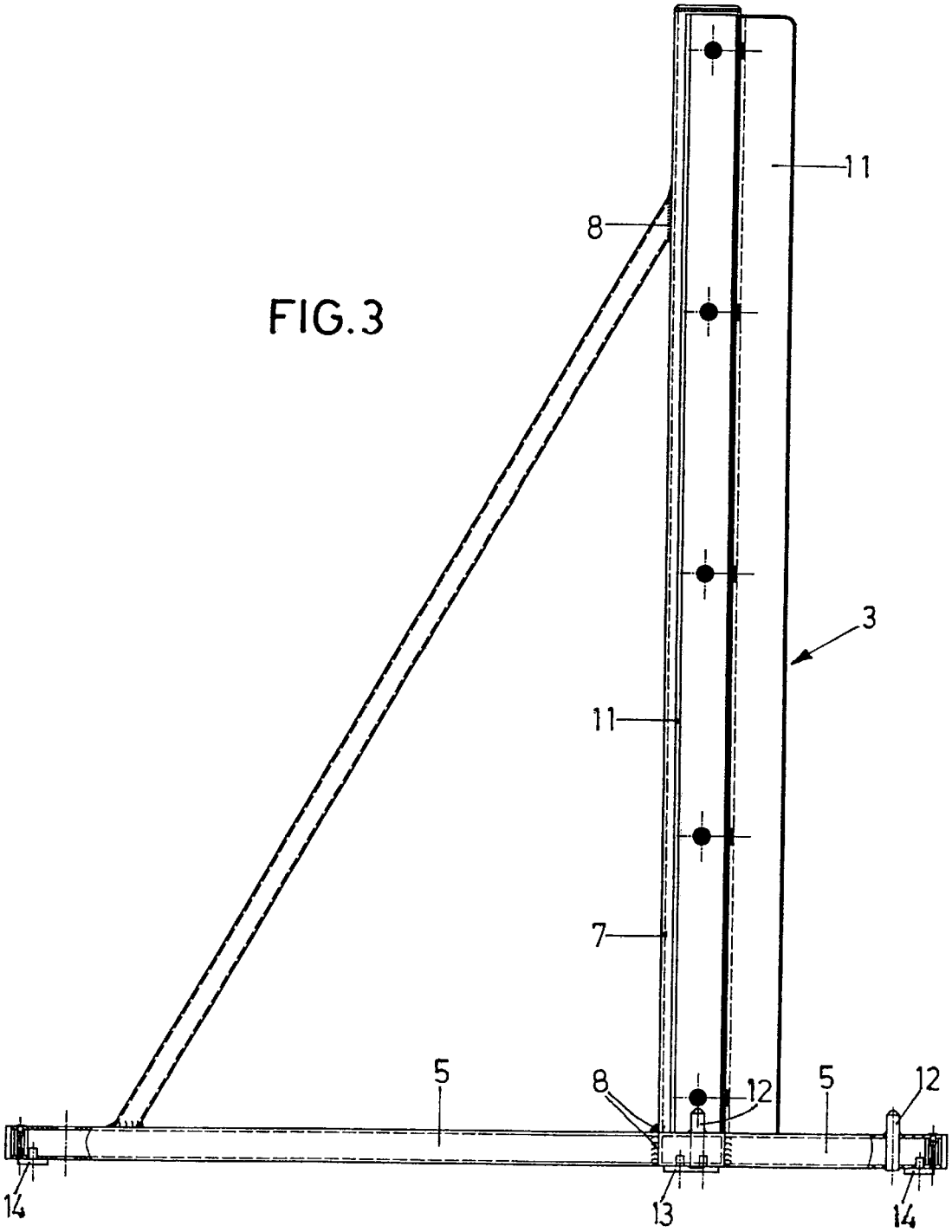
FIG. 3 is a side view of the corner connecting element according to FIG. 2.

Secured to the connecting ribs 7 are U profiles 11, which extend at a 180° angle relative to one another in the connecting elements 2, and at a 90° angle in the corner connecting elements 3, as illustrated in FIG. 2, these constituting grooves to receive the edges of the band elements (panels) 1. The opening width of the U-profiles corresponds to the sheet thickness of the band elements 1, so the band elements 1 can be inserted with a form-fit into these U profiles 11 or U rails.

A locking pin or mandrel 12 is fixed, e.g. welded, into the profiles 5 that form the support surface 4, at a distance from the vertical connecting ribs 7. The mandrel 12 engages a corresponding recess, not visible in the drawing, in the bottom of a band element 1 when the band element 1 is inserted into the corresponding U profile 11. This produces a form-fitting stable connection in the peripheral direction because of the combination of the mandrel 12 and the U profiles which counteract tilting moments. This connecting technique allows the playing-field enclosure to be constructed particularly simply and quickly. Sliding elements 13, 14 mounted to the bottom of the profiles 5 permit the connecting elements 2, 3 to be displaced easily, thus preventing damage to the ground.

Gates 15 can be provided at two opposite end faces of the playing field, the gates 15 likewise having lateral U profiles 16 that correspond to the U profiles 11, and, at the underside, horizontal projections 17, each of which has a mandrel (not visible in the drawing) corresponding to the mandrel 12, so the connection between the band elements 1 and the gate 15 can be produced in the same way as the connection between the band elements 1 and the connecting elements 2, 3.

The side parts 18 of the gates 15 can be hinged in the manner of a door, so the playing field can be entered and exited easily, without compromising the stability of the overall arrangement in some way.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of alternative forms without departing from the invention.

Thus the expressions "means to . . ." and "means for . . .", or any method step language, as may be found in the specification above and/or in the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same functions can be used; and it is intended that such expressions be given their broadest interpretation.

What is claimed is:

1. A playing-field enclosure, particularly adapted for ball games, comprising a peripheral, vertical band formed from a plurality of sheet-type band elements, which are connectable to one another in a form-fit, connecting elements (2, 3) disposed between two respective sheet-type band elements (1), the connecting elements having a support surface (4) and a connecting rib (7) which extends vertically upward from the support surface (4); wherein the connecting rib (7) has vertically-extending U profiles (11) with parallel to one another extending inner lateral walls on opposite sides, or sides that are offset from one another by 90°, with the band elements (1) being insertable into the U profile with a form-fit; and a positioning region of the elements (1), the support surface (4) has an upwardly extending retaining recess of said band elements (1) insert into the U profile (11).

2. The playing-field enclosure according to claim 1, wherein the band elements (1) comprise high-resistance foam sheets that are coated with steel plates.

3. The playing-field enclosure according to claim 2, wherein the band elements (1) have a plastic frame.

4. The playing-field enclosure according to claim 1, wherein the support surface (4) is formed by profiles (5) in a cross arrangement.

5. The playing-field enclosure according to claim 1, wherein the vertical connecting rib (7) comprises a hollow profile, and a net-holding pin (9) is insertable into the ribs with a form-fit.

6. The playing-field enclosure according to claim 1, wherein the band elements (1) are connectable with retaining mandrels that are mounted to the side of a gate (15), the gate (15) having lateral U profiles (16) for receiving the band elements (1).

7. The playing-field enclosure according to claim 6, wherein the gate (15) has a side part (18) comprising a door.

8. The playing-field enclosure according to claim 1, wherein the band elements (1) are held in the connecting elements (2, 3) with play at the top.

* * * * *